US009808924B2

(12) United States Patent
Wu

(10) Patent No.: US 9,808,924 B2
(45) Date of Patent: Nov. 7, 2017

(54) NAIL GUN

(71) Applicant: APEX MFG. CO., LTD., Taichung (TW)

(72) Inventor: Chu Wu, Taichung (TW)

(73) Assignee: Apex Mfg. Co., Ltd., Taichung (TW)

( * ) Notice: Subject to any disclaimer, the term of this patent is extended or adjusted under 35 U.S.C. 154(b) by 317 days.

(21) Appl. No.: 14/828,032

(22) Filed: Aug. 17, 2015

(65) Prior Publication Data

US 2015/0352703 A1 Dec. 10, 2015

Related U.S. Application Data

(63) Continuation-in-part of application No. 13/419,712, filed on Mar. 14, 2012, now abandoned.

(30) Foreign Application Priority Data

Jan. 13, 2012 (TW) ..... 101101353 A

(51) Int. Cl.
*B25C 5/02* (2006.01)
*B25C 5/06* (2006.01)
*B25C 5/16* (2006.01)

(52) U.S. Cl.
CPC ..... *B25C 5/1651* (2013.01); *B25C 5/06* (2013.01); *B25C 5/1658* (2013.01)

(58) Field of Classification Search
CPC ..... B25C 1/184; B25C 5/16; B25C 5/1693; B25C 5/06; B25C 5/1651
USPC ..... 227/119–128
See application file for complete search history.

(56) References Cited

U.S. PATENT DOCUMENTS 4,556,161 A 12/1985 Oide
6,450,388 B1 * 9/2002 Denton ..... E01B 29/24 173/30
6,481,612 B1 * 11/2002 Mangone, Jr. ..... B25C 5/00 227/130
6,837,412 B2 * 1/2005 Lamb ..... B25C 5/1693 227/120
7,594,598 B2 9/2009 Chen et al.
7,909,218 B2 * 3/2011 Jiang ..... B25C 5/025 227/120
2005/0236457 A1 * 10/2005 Hong ..... B25C 5/1617 227/109
2008/0179371 A1 7/2008 Gardner et al.
2011/0180583 A1 7/2011 Wang
(Continued)

FOREIGN PATENT DOCUMENTS

TW M355151 4/2009

*Primary Examiner* — Robert Long
(74) *Attorney, Agent, or Firm* — Muncy, Geissler, Olds & Lowe, P.C.

(57) ABSTRACT

A nail gun of the present invention includes an adjusting portion which has elasticity. The elasticity of the adjusting portion is able to offset a thrust force of a nail pusher pushed by a magazine, so that a nail slot receives a nail only. The nail gun ensures not to shoot two sticks of nails simultaneously. The nail squeezes one side of the adjusting portion in a firing process so that the nail gun can provide sufficient space. Thereby when the nail is thicker, it can be shot by the nail gun. The present invention need not adjust by hand anymore for shooting different thickness of nails. The nail gun can not shoot two sticks of nails simultaneously.

18 Claims, 5 Drawing Sheets

(56) References Cited

U.S. PATENT DOCUMENTS

2013/0221056 A1* 8/2013 Chen ..... B25C 5/162
227/120

* cited by examiner

NAIL GUN

The present invention is a CIP of application Ser. No. 13/419,712, filed Mar. 14, 2012, the entire contents of which are hereby incorporated by reference.

BACKGROUND OF THE INVENTION

Field of the Invention

Description of the Prior Art

Normal nail guns are used for many kinds of nails. Each kind of nail has different shape and thickness. If a nail gun fills with different kinds of nails therein and the thickness of some nails is different, the nail gun will shoot several sticks of nails at a time. In other to get over the problem, users have to prepare many exclusive nail guns for different kinds of nails when users need to use different kinds of nails for work. However, it is quite inconvenient.

In other to a nail gun is able to be used for many kinds of nails, such as disclosed in TW M355151. This nail gun has a platen disposed at the front of the magazine. A gun body is formed with a receiving hole. The receiving hole receives a controlling member therein. The controlling member pushes the platen selectively so that the platen is able to move with respect to a front end and a second end of the gun body. Consequently, users are able to have the platen moved by operating the controlling member. As such, the size of a seam in the nail gun can be controlled and further avoid the punching board pushing two sticks of nails simultaneously when the nail gun is shooting. However, this nail gun has to adjust the controlling member constantly as the type of nail. However, users may neglect to adjust the controlling member by themselves so that the nail gun shoots two sticks of nails simultaneously.

US2008/0179371 discloses that the fastener driving device is electrically-driven type, in which the pressing element serves as an electric switch and does not cooperate mechanically with the detent portion. That is, press of the pressing element cannot make the detent portion compress itself and accumulate an accumulating force at the same time when the pressing element is pressed. Besides, the adjusting portion and the nail slot are disposed along the same direction, and the adjusting portion and the magazine are disposed perpendicular to each other. Furthermore, the adjusting portion and the magazine are located at the same side of the nail slot. In fact, the adjusting portion should be regarded as equivalent to the elastic plate (extending within the top housing) of the invention but not the detent portion. The spring can just push the punching board forward and outward but cannot elastically rebound. Therefore, the spring cannot be adapted for many kinds of nails with different shape and thickness.

The present invention is, therefore, arisen to obviate or at least mitigate the above mentioned disadvantages.

SUMMARY OF THE INVENTION

The main object of the present invention is to provide a nail gun which is adapted for many kinds of nails. The nail gun can shoot a nail at a time and maintain its shooting state spontaneously so that users need not adjust the nail gun by hand anymore.

To achieve the above and other objects, a nail gun of the present invention comprises a main body, a magazine, and an adjusting portion.

The main body comprises a pressing element, an outer housing, a punching board, and a detent portion. The outer housing is formed with a nail slot. The punching board is capable of moving along the nail slot. The detent portion drives the punching board along the nail slot to move toward a first direction when the pressing element moves with respect to the outer housing.

The magazine is disposed in the outer housing. The magazine is adapted to fill with a plurality of nails. The magazine has a nail pusher. The nail pusher pushes the nail when the magazine has one nail therein, so that the nail has a tendency to move toward the nail slot at any time.

The adjusting portion is disposed in the outer housing. The adjusting portion comprises an elastic member. The nail abuts the punching board when the nail pusher pushes the nail to move to the nail slot. The nail is pushed by the punching board so as to stay in the nail slot temporarily. The detent portion drives the punching board to move back first when the detent portion drives the punching board along the nail slot to move toward the first direction, so that the nail separates from the punching board and abuts the adjusting portion. And then the detent portion drives the punching portion to move toward the first direction and pushes the nail located in the nail slot, so that the nail is away from the nail slot. Wherein the adjusting portion presses the elastic member to be transformed when the nail abuts the adjusting portion. At the present time, an elastic force of the elastic member would still let the adjusting portion has enough power to prevent another nail adjacent to the nail from moving toward the nail slot continuously. Another nail can not enter the nail slot. The punching board just pushes the nail located in the nail slot when the punching board is moving.

The nail moves toward one side of the adjusting portion when the punching board pushes the nail, at the moment. A point of application of force of the nail with respect to the adjusting portion moves toward one side of the adjusting portion, so that two sides of the adjusting portion receiving the pressure from the nail are unequal and the adjusting portion slants toward one side of the nail. The nail takes advantage of such pushing effect to push the adjusting portion away, and then the nail leaves the nail slot.

Whereby the present invention makes use of an elastic force of the elastic member to provide to the adjusting portion so that the adjusting portion abuts the nail and the nail pusher can not push the nail anymore. Another nail adjacent to the nail can not enter the nail slot. It can avoid the punching board in a moving process from shooting two sticks of nails. Even if the nail is thicker, the nail still can take advantage of such pushing effect to push the adjusting portion away. As a result, the nail gun can provide sufficient space for receiving the thicker nail and shoot the nail out smoothly.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figures 1, 1A, 1B:
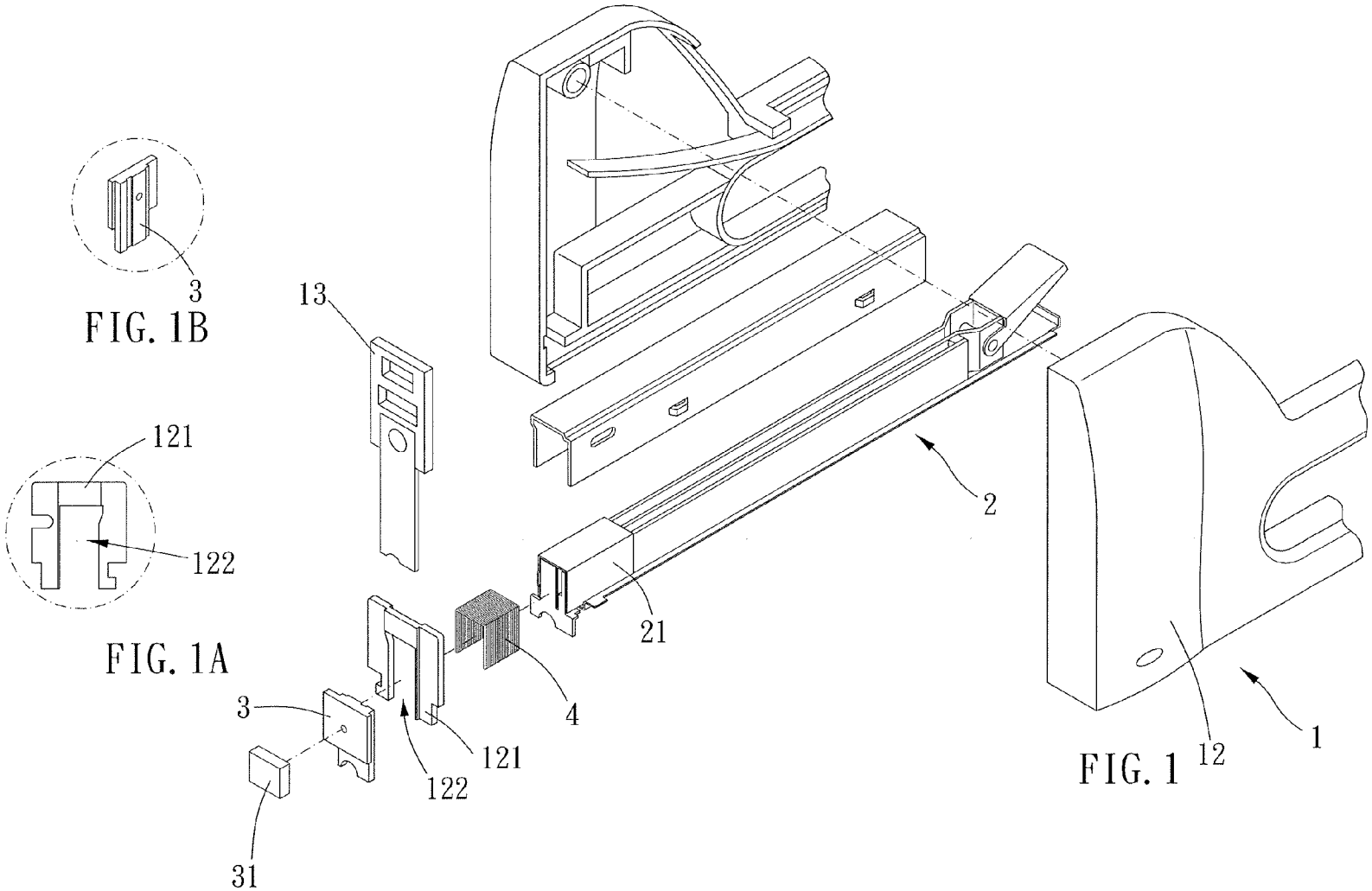
FIG. 1 is a breakdown drawing of the present invention.
FIG. 1A is a schematic drawing showing another viewing angle of a guiding member of the present invention.
FIG. 1B is a schematic drawing showing another viewing angle of an adjusting portion of the present invention.
Figure 2:
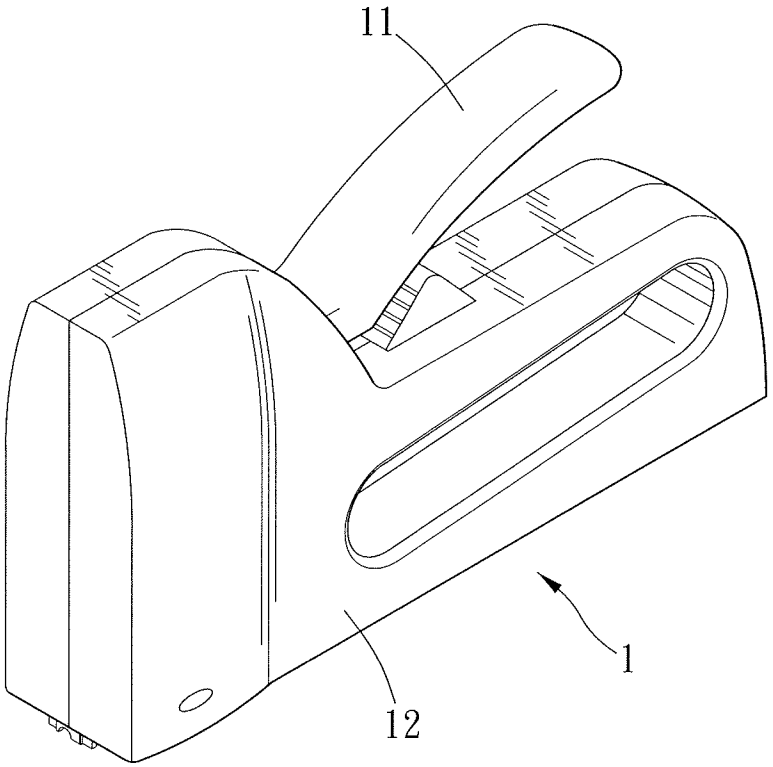
FIG. 2 is a stereogram of the present invention.
Figure 3:
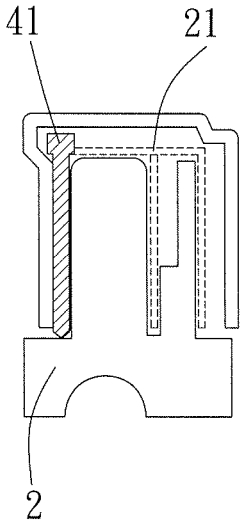
FIG. 3 is a cross-section view showing a magazine filled with T-shaped nails.
Figure 4:
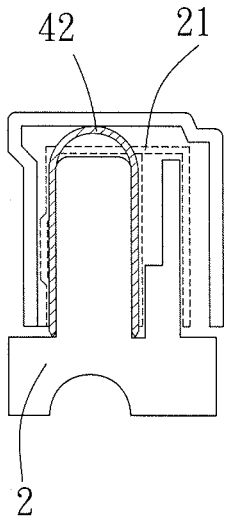
FIG. 4 is a cross-section view showing a magazine filled with U-shaped cable staples.
Figure 5:
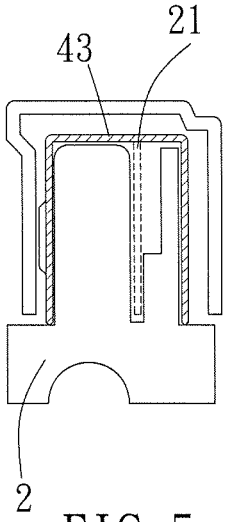
FIG. 5 is a cross-section view showing a magazine filled with thinner staples.
Figure 6:
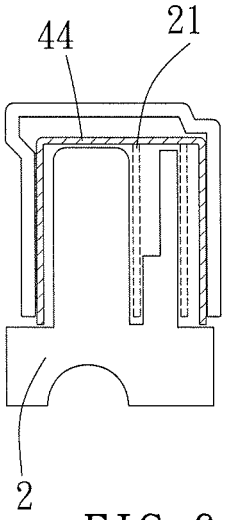
FIG. 6 is a cross-section view showing a magazine filled with thicker staples.

Please refer to FIG. 1 to FIG. 2. The nail gun of the present invention comprises a main body 1, a magazine 2, and an adjusting portion 3.

The main body 1 comprises a pressing element 11, an outer housing 12, a punching board 13, and a detent portion. The outer housing 12 is formed with a nail slot. The punching board 13 is capable of moving along the nail slot. The detent portion drives the punching board 13 along the nail slot to move toward a first direction when the pressing element 11 moves with respect to the outer housing 12. And the nail gun has accomplished a firing action. The pressing element 11 mainly acts as a switch to operate the firing action. The detent portion is used to drive the punching board 13 to move. Actually, the detent portion is a power source for shooting. The detent portion makes use of an accumulating force of its elasticity to compress itself. The detent portion is released the accumulating force by the pressing element 11, therefore, it can push the punching board 13 to move toward the first direction.

The magazine 2 disposed in the outer housing 12 is adapted to fill with a plurality of nails 4. More specifically, the types of the nails received in the magazine 2 at least include T-shaped nails, U-shaped cable staples, thicker staples or thinner staples etc, as shown in FIG. 3 to FIG. 6. The magazine 2 has a nail pusher 21. The nail pusher 21 pushes the nail when the magazine 2 has one nail therein, so that the nail has a tendency to move toward the nail slot at any time.

Figure 7:
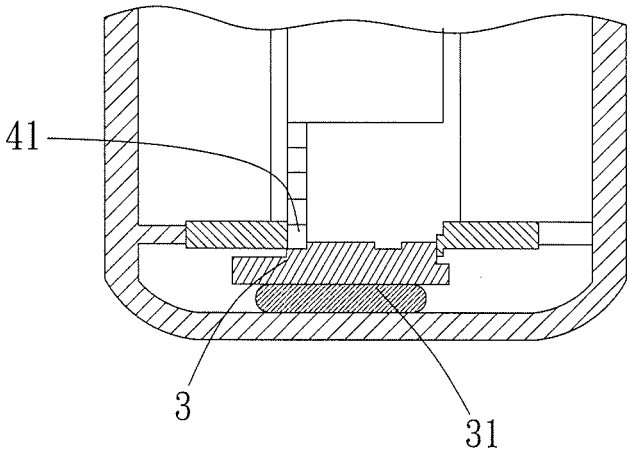
FIG. 7 is a cross-section view showing a T-shaped nail abuts an adjusting portion.
Figure 8:
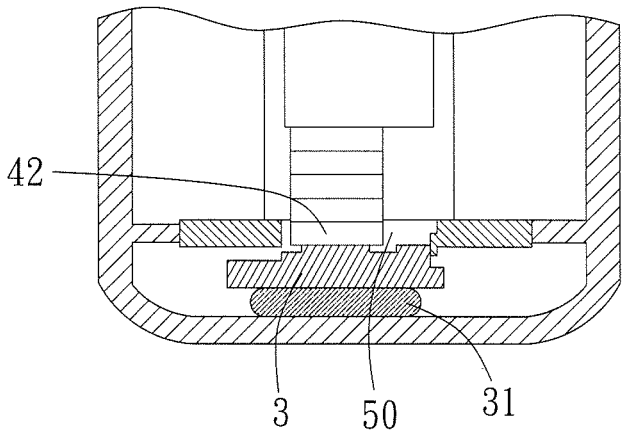
FIG. 8 is a cross-section view showing a U-shaped cable staple abuts an adjusting portion.

Please refer to FIG. 1 and FIG. 1B. The adjusting portion 3 disposed in the outer housing 12 comprises an elastic member 31. One side of the elastic member 31 abuts the outer housing 12, the other side of the elastic member 31 abuts the adjusting portion 3. The elastic member 31 provides an elastic force to the adjusting portion 3. Therefore, the adjusting portion 3 is flexible and keeps expanding toward an expanding direction at any time. The expanding direction of the adjusting portion 3 is different from a moving direction of the nail pushed by the nail pusher 21. When the nail 4 is T-shaped nail 41 or U-shaped cable staple 42 and the nail pusher 21 pushes the nail 4 to move to the nail slot, the nail 4 abuts the punching board 13. The nail 4 is pushed by the punching board 13 so as to stay in the nail slot temporarily. When the detent portion drives the punching board 13 along the nail slot to move toward the first direction and the detent portion produce a power with the accumulating force, the detent portion drives the punching board 13 to move backward an opposite direction of the punching board 13 and the detent portion starts to compress itself and accumulate the accumulating force. At the moment, the nail 4 separates from the punching board 13 and abuts the adjusting portion 3, as shown in FIG. 7 and FIG. 8. After the detent portion accomplished to accumulate the accumulating force, the detent portion just drives the punching board 13 to move toward the first direction and pushes the nail 4 located in the nail slot 50. The nail 4 is away from the nail slot 50 and shot out of the nail gun. When the punching board moves back before the detent portion starts to fire, the nail 4 is pushed by a thrust force of the nail pusher 21 and abuts the adjusting portion 3. The adjusting portion 3 presses the elastic member 31 to be transformed. Thereafter, the adjusting portion 3 will move backward a distance. At the present time, an elastic force of the elastic member provides to the adjusting portion 3, so that the adjusting portion 3 still has enough power to prevent another nail adjacent to the nail 4 from moving to the nail slot 50 continuously. That is, the backward distance of the adjusting portion 3 defines a receiving space. The receiving space is enough for receiving a stick of nail merely. Another nail can not enter the nail slot 50. When the punching board 13 is moving, it just pushes the nail 4 located in the nail slot 50.

Wherein the material of the elastic member is not restricted. Any kind of elastic member can be applied in the present invention as long as the value of Rockwell hardness (HRC) of the elastic member is between 40 and 90. Preferably, the value of Rockwell hardness of the elastic member is 70. In the present embodiment, the material of the elastic member is rubber. More definitely, the elastic member is a rubber soft pad. The value of Rockwell hardness of the rubber soft pad is 70. When the elastic member 31 possesses such hardness and the adjusting portion 3 receives the thrust force (the weight is between 0.1 and 1.5 kilograms) of the nail pusher 21, the backward distance of the adjusting portion 3 would maintain between 0.8 and 0.95 millimeters and define the receiving space. As far as a common nail whose thickness is about 0.7 millimeters is concerned, the receiving space is enough for receiving a stick of nail merely. In this way, another nail adjacent to the nail can not enter the nail slot 50.

The outer housing 12 further has a guiding member 121, as shown in FIG. 1 and FIG. 1A. The guiding member 12 is formed with a through groove 122. A longitudinal direction of the through groove 122 is parallel to a moving direction of the punching board 13. The adjusting portion 3 is located in the through groove 122 and is able to move with respect to the guiding member 121. A periphery of the through groove 122 is adapted for a lateral side of the nail 4 to be abutted so that a flying stability of the nail 4 is ensured.

Specifically, the adjusting portion 3 and the magazine 2 have longitudinal axes that are perpendicular to each other and located at two opposing sides of the nail slot 50 which are located on the longitudinal axis of the magazine 2. The adjusting portion 3 oppositely faces and is close to a distal end of the magazine 2. A first gap 51 is formed between the adjusting portion 3 and the distal end of the magazine 2, the first gap 51 is aligned and communicated with the nail slot 50, and the elastic member is disposed on the outer housing 12 and between the adjusting portion 3 and the outer housing 12. The adjusting portion 3, the elastic member, the first gap 51 and the nails are disposed on the longitudinal axis of the magazine 2. The adjusting portion 3 normally abuts against the punching board 13 as the adjusting portion 3 is not pushed by the nail 4 which is pushed by the nail pusher 21. The adjusting portion 3 includes an extension 52 projecting out of the outer housing 12, a second gap 54 is formed between the extension 52 and a lip 53 of the outer housing 12, the second gap 54 is aligned and communicated with the first gap 51, and the nail 4 is pushed out through the second gap 54. The adjusting portion 3 further includes a first shoulder 55 connected with the extension 52, and the first shoulder 55 is disposed within and blockably abutted against the outer housing 12. The outer housing 12 further includes a second shoulder 56 which is complementarily abutted against the first shoulder 55.

Figure 10:
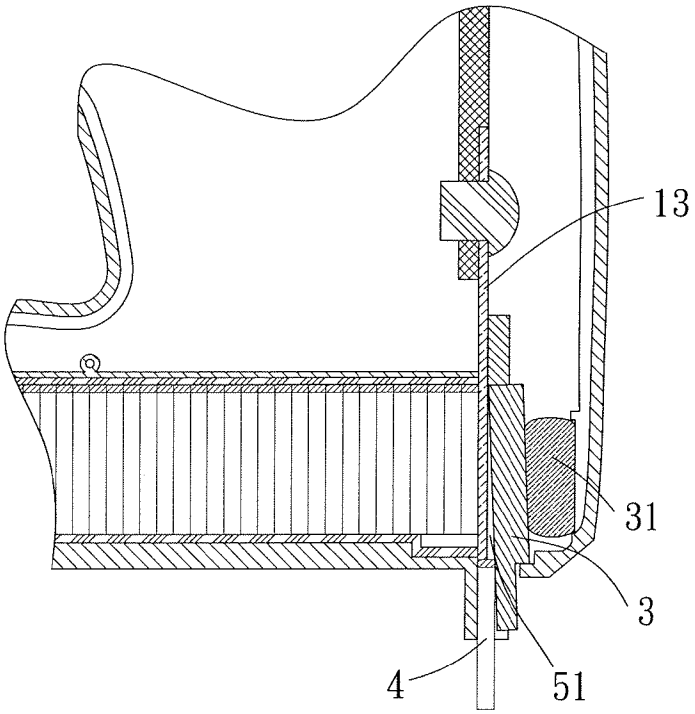
FIG. 10 is a cross-section view showing a nail gun is shooting.
Figure 9:
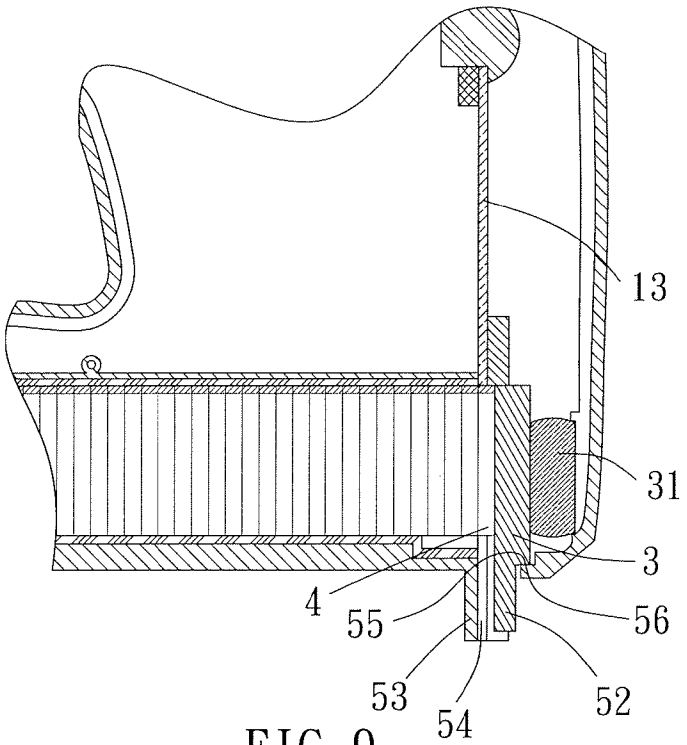
FIG. 9 is a cross-section view showing a nail gun before shooting.

It is important that the elastic member possesses such hardness. When the adjusting portion pushes the nail, the nail 4 moves toward one side of the adjusting portion 3. At the same time, a point of application of force of the nail 4 with respect to the adjusting portion 3 moves toward one side of the adjusting portion 3, so that two sides of the adjusting portion 3 receiving the pressure from the nail 4 are unequal and the adjusting portion 3 slants toward one side of the nail 4, as shown in FIG. 9 and FIG. 10. The nail 4 takes advantage of such pushing effect to push one side of the adjusting portion 3 away (the pushing distance between 0.2 and 0.4 millimeters), and then the nail 4 leaves the nail slot. More specifically, when the nail 4 moves to one side of the adjusting portion 3, the point of application of force of the nail 4 with respect to the adjusting portion 3 moves toward one side of the adjusting portion 3. When two sides of the adjusting portion 3 receiving the pressure from the nail 4 are unequal and an elastic hardness of one side of the elastic member 31 is insufficient to support the thrust force of the nail given the adjusting portion 3, the shape of one side of the elastic member 31 would transform much severely to resist the thrust force of the nail 4. At the present time, the adjusting portion 3 slants toward one side of the nail 4. One side of the adjusting portion 3 would move back more and be squeezed by the nail. More clearly, the backward distance of the adjusting portion 3 is between 0.8 and 0.95 millimeters. When one side of the adjusting portion 3 is squeezed by the nail 4 again, one side of the adjusting portion 3 would move back more about 0.2 to 0.4 millimeters. At the same time, the backward distance of the adjusting portion 3 is 1.0 to 1.35 millimeters totally. In this way, the nail gun is adapted for a nail, whose thickness is 1.2 millimeters, to be shot smoothly. The nail is not stuck in the nail gun because of insufficient receiving space.

Therefore, the present invention takes advantage of the elastic force of the adjusting portion 3 to restrict the nail slot to receive a nail only. Hereby the nail gun can not shoot two sticks of nails or more simultaneously. Even through the nail is thicker, the nail still squeeze the adjusting portion temporarily with the squeezing action and then leaves the nail slot smoothly. The firing action has accomplished. The nail gun of the present invention need not adjust for shooting different thickness of nails.

As such, the nail gun of the present invention is adapted for many kinds of nails. Each kind of nail has different shape and thickness. The nail gun is no more adjusted, because the adjusting portion have the nail slot received a nail only. The nail gun can not shoot two sticks of nails simultaneously. Users do not worry about neglecting to adjust the nail gun and shooting two sticks of nails simultaneously. The use of the nail gun of the present invention is quite convenient and safe.

What is claimed is:

1. A nail gun, comprising:

a main body, comprising a pressing element, an outer housing, a punching board, and a detent portion, the outer housing being formed with a nail slot, the punching board being capable of moving along the nail slot, the detent portion driving the punching board along the nail slot when the pressing element moves with respect to the outer housing;

a magazine, disposed in the outer housing, the magazine being adapted to fill with a plurality of nails, the magazine having a nail pusher, the nail pusher pushing the nail when the magazine having one nail therein, so that the nail has a tendency to move toward the nail slot at any time;

an adjusting portion, disposed in the outer housing, the adjusting portion connected with an elastic member, the nail abutting the punching board when the nail pusher pushing the nail to move to the nail slot, the nail being pushed by the punching board so as to stay in the nail slot temporarily, the detent portion driving the punching board to move back first when the detent portion driving the punching board along the nail slot, so that the nail separates from the punching board and abuts the adjusting portion, and then the detent portion drives the punching portion to move and pushes the nail located in the nail slot, so that the nail is away from the nail slot, wherein the adjusting portion presses the elastic member to be transformed when the nail abuts the adjusting portion, at the present time, an elastic force of the elastic member would still let the adjusting portion has enough power to prevent another nail adjacent to the nail from moving toward the nail slot continuously, another nail can not enter the nail slot, the punching board just pushes the nail located in the nail slot when the punching board is moving;

wherein the detent portion is driven mechanically by the pressing element to compress itself and accumulate an accumulating force when the pressing element moves with respect to the outer housing;

wherein the adjusting portion and the magazine have longitudinal axes that are perpendicular to each other and located at two opposing sides of the nail slot which are located on the longitudinal axis of the magazine;

wherein the adjusting portion oppositely faces and is close to a distal end of the magazine, a first gap is formed between the adjusting portion and the distal end of the magazine, the first gap is aligned and communicated with the nail slot, the elastic member is disposed on the outer housing and between the adjusting portion and the outer housing, the adjusting portion, the elastic member, the first gap and the nails are disposed on the longitudinal axis of the magazine;

wherein the adjusting portion normally abuts against the punching board as the adjusting portion is not pushed by the nail which is pushed by the nail pusher.

2. The nail gun of claim 1, wherein the nail moves toward one side of the adjusting portion when the punching board pushes the nail, at the moment, a point of application of force of the nail with respect to the adjusting portion moves toward one side of the adjusting portion, so that two sides of the adjusting portion receiving the pressure from the nail are unequal and the adjusting portion slants toward one side of the nail, the nail takes advantage of such pushing effect to push the adjusting portion away, and then the nail leaves the nail slot.

3. The nail gun of claim 1, wherein one side of the elastic member abuts the outer housing, the other side of the elastic member abuts the adjusting portion.

4. The nail gun of claim 1, wherein the value of Rockwell hardness (HRC) of the elastic member is between 40 and 90.

5. The nail gun of claim 1, wherein the outer housing further has a guiding member, the guiding member is formed with a through groove, a longitudinal direction of the through groove is parallel to a moving direction of the punching board, the adjusting portion is located in the through groove and is able to move with respect to the guiding member.

6. The nail gun of claim 1, wherein the magazine is adapted to be filled T-shaped nails, U-shaped cable staples, thicker staples or thinner staples.

7. The nail gun of claim 2, wherein the magazine is adapted to fill with T-shaped nails, U-shaped cable staples, thicker staples or thinner staples.

8. The nail gun of claim 3, wherein the magazine is adapted to fill with T-shaped nails, U-shaped cable staples, thicker staples or thinner staples.

9. The nail gun of claim 4, wherein the magazine is adapted to fill with T-shaped nails, U-shaped cable staples, thicker staples or thinner staples.

10. The nail gun of claim 5, wherein the magazine is adapted to fill with T-shaped nails, U-shaped cable staples, thicker staples or thinner staples.

11. The nail gun of claim 1, wherein the elastic member is a rubber soft pad, the value of Rockwell hardness of the rubber soft pad is 70.

12. The nail gun of claim 2, wherein the elastic member is a rubber soft pad, the value of Rockwell hardness of the rubber soft pad is 70.

13. The nail gun of claim 3, wherein the elastic member is a rubber soft pad, the value of Rockwell hardness of the rubber soft pad is 70.

14. The nail gun of claim 4, wherein the elastic member is a rubber soft pad, the value of Rockwell hardness of the rubber soft pad is 70.

15. The nail gun of claim 5, wherein the elastic member is a rubber soft pad, the value of Rockwell hardness of the rubber soft pad is 70.

16. The nail gun of claim 1, wherein the adjusting portion includes an extension projecting out of the outer housing, a second gap is formed between the extension and a lip of the outer housing, the second gap is aligned and communicated with the first gap, and the nail is pushed out through the second gap.

17. The nail gun of claim 16, wherein the adjusting portion further includes a first shoulder connected with the extension, and the first shoulder is disposed within and blockably abutted against the outer housing.

18. The nail gun of claim 17, wherein the outer housing further includes a second shoulder which is complementarily abutted against the first shoulder.

* * * * *